US008028668B2

(12) United States Patent
Choi

(10) Patent No.: US 8,028,668 B2
(45) Date of Patent: Oct. 4, 2011

(54) ROCKER ARM FOR VARIABLE VALVE LIFT, AND VARIABLE VALVE LIFT APPARATUS HAVING THE SAME

(75) Inventor: Myungsik Choi, Seoul (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 670 days.

(21) Appl. No.: 12/132,344

(22) Filed: Jun. 3, 2008

(65) Prior Publication Data

US 2009/0145389 A1 Jun. 11, 2009

(30) Foreign Application Priority Data

Dec. 6, 2007 (KR) ..... 10-2007-0126231

(51) Int. Cl.
*F01L 1/18* (2006.01)

(52) U.S. Cl. ..... 123/90.45; 123/90.39; 123/90.4; 123/90.44

(58) Field of Classification Search ..... 123/90.44, 123/90.45, 90.4, 90.41, 90.39, 90.16, 90.43, 123/90.46, 90.47
See application file for complete search history.

(56) References Cited

U.S. PATENT DOCUMENTS

| | | | | |
|---|---|---|---|---|
| 5,020,488 | A * | 6/1991 | Watanabe | 123/90.16 |
| 5,085,182 | A * | 2/1992 | Nakamura et al. | 123/90.16 |
| 5,251,586 | A * | 10/1993 | Koga et al. | 123/90.16 |
| 5,386,806 | A * | 2/1995 | Hurr et al. | 123/90.16 |
| 5,452,694 | A * | 9/1995 | Hara | 123/90.16 |
| 5,913,293 | A * | 6/1999 | Ochiai | 123/90.33 |
| 6,135,075 | A * | 10/2000 | Boertje et al. | 123/90.16 |
| 7,565,887 | B2 * | 7/2009 | Tsuruta et al. | 123/90.16 |
| 2003/0111031 | A1 * | 6/2003 | Hendricksma et al. | 123/90.15 |

FOREIGN PATENT DOCUMENTS

JP 5-231115 A 9/1993

* cited by examiner

*Primary Examiner* — Kenneth Bomberg
*Assistant Examiner* — Daniel Bernstein
(74) *Attorney, Agent, or Firm* — Morgan, Lewis & Bockius LLP

(57) ABSTRACT

The present invention provides a variable valve lift including a housing, a plurality of swing arms that are rotatably arranged at the housing, and a plurality of latching mechanisms for selectively latching the plurality of swing arms.

19 Claims, 11 Drawing Sheets

ROCKER ARM FOR VARIABLE VALVE LIFT, AND VARIABLE VALVE LIFT APPARATUS HAVING THE SAME

CROSS-REFERENCE TO RELATED APPLICATION

This application claims priority to and the benefit of Korean Patent Application No. 10-2007-0126231 filed in the Korean Intellectual Property Office on Dec. 6, 2007, the entire contents of which are incorporated herein by reference.

BACKGROUND OF THE INVENTION (a) Field of the Invention

The present invention relates to an engine of a vehicle and more particularly, a rocker arm for a variable valve lift (VVL) apparatus and a variable valve lift apparatus having the same.

(b) Description of the Related Art

An internal combustion engine generates power by burning fuel in a combustion chamber in an air media that is drawn into the chamber. Intake valves are operated by a camshaft in order to take in the air, and the air is drawn into the combustion chamber while the intake valves are open. In addition, exhaust valves are operated by the camshaft, and a combustion gas is exhausted from the combustion chamber while the exhaust valves are open.

An optimal operation of the intake valves and the exhaust valves depends on a rotation speed of the engine. That is, optimal opening/closing timing of the valves or an optimal lift depends on the rotation speed of the engine. In order to achieve such an optimal valve operation depending on the rotation speed of the engine, research has been undertaken on a variable valve lift (VVL) apparatus that enables different valve lifts depending on the engine speed.

As an example of the VVL apparatus, a hydraulic line is formed for each desired valve lift, and oil supply to the hydraulic line is controlled by an oil control valve (OCV).

According to such a scheme, in order to achieve a variety of valve lifts, the number of hydraulic lines should be increased or a greater number of OCVs should be employed even though the OCV typically occupies a large volume in the cylinder head. Considering that the cylinder head has limited space, only a limited number of OCVs can be installed in the cylinder head, and an increase of the number of the OCVs employed results in complexity of a hydraulic circuit in the cylinder head and an increase of manufacturing cost.

Therefore, if a VVL apparatus may be realized by merely redesigning a single part (e.g., a rocker arm), an improvement of performance of an engine may be expected without incurring substantial cost, and a smaller-size and higher-performance engine may be achieved.

In addition, research has been undertaken on a cylinder deactivation function in which a specific cylinder may be deactivated when the engine may be operated at a relatively low output power. This cylinder deactivation enables improvement of fuel consumption of the engine without deteriorating maximum power of the engine.

Accordingly, if an improved VVL apparatus enables such a cylinder deactivation function, performance of the engine may be improved in various aspects with minimal cost and space loss of the engine.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a variable valve lilt (VVL) apparatus having advantages of enabling a variable valve lift in a simple scheme so as to achieve a small-size and high-performance engine, and enabling a cylinder deactivation function.

An exemplary embodiment of the present invention provides a rocker arm for a variable valve lift apparatus that includes a housing, a plurality of swing arms rotatably arranged at the housing, and a plurality of latching mechanisms for selectively latching the plurality of swing arms.

Another exemplary embodiment of the present invention provides a rocker arm for a variable valve lift apparatus that includes: a housing; a plurality of swing arms rotatably arranged at the housing; a plurality of springs that apply elastic force to the plurality of swing arms in a direction toward a camshaft; and a plurality or latching mechanisms for selectively latching the plurality of swing arms. In the housing, a plurality of lash adjuster receiving indentations that receive a plurality of lash adjusters are formed, at least one valve receiving indentation for receiving a valve is formed at an opposite side of the plurality of lash adjuster receiving indentations, and a plurality of oil passages for supplying oil from the plurality of lash adjuster receiving indentations to the plurality of latching mechanisms are formed.

The plurality of latching mechanisms may include a latching mechanism maintaining a latched position when not operated, or a latching mechanism maintaining an unlatched position when not operated.

The plurality of swing arms may be provided with a roller or a pad at a portion contacting a cam.

The plurality of swing arms may include a first swing arm and second and third swing arms respectively arranged at left and right sides of the first swing arm, and the plurality of latching mechanisms may include first, second, and third latching mechanisms for respectively latching the first, second, and third swing arms.

The plurality of lash adjuster receiving indentations may include a first lash adjuster receiving indentation and second and third lash adjuster receiving indentations respectively arranged at left and right sides of the first lash adjuster receiving indentation, and the plurality of oil passages may include first, second, and third oil passages that respectively connect the first, second, and third lash adjuster receiving indentations with the first, second, and third latching mechanisms.

The plurality of lash adjuster receiving indentations may include a first lash adjuster receiving indentation for supplying oil to the first latching mechanism, and a second lash adjuster receiving indentation for supplying oil to the second and third latching mechanisms.

The plurality of swing arms may include a first swing arm, second and third swing arms respectively arranged at left and right sides of the first swing arm, and fourth and fifth swing arms respectively arranged adjacent to the second and third swing arms, and the plurality of latching mechanisms may include first, second, third fourth, and fifth latching mechanisms for respectively latching the first, second, third, fourth, and fifth swing arms.

The plurality of lash adjuster receiving indentations may include the first, second, and third lash adjuster receiving indentations, and the plurality of oil passages may include a first oil passage connecting the first lash adjuster receiving indentation with the first latching mechanism, second and third oil passages connecting the second lash adjuster receiving indentation with the second and third latching mechanisms, and fourth and fifth oil passages connecting the third lash adjuster receiving indentation with the fourth and fifth latching mechanisms.

An exemplary embodiment of the present invention provides a variable valve lift apparatus for operating a valve of an engine at a plurality of lifts, where the variable valve lift apparatus includes: a camshaft having a plurality of cams of different profiles for each cylinder; a plurality of lash adjusters arranged at a cylinder head; an oil pipe formed in the cylinder head so as to supply oil to the plurality of lash adjusters; and a rocker arm that is arranged below the camshaft and contacts the plurality of lash adjusters and the valve. The rocker arm includes: a housing; a plurality of swing arms rotatably arranged at the housing: a plurality of springs that apply elastic force to the plurality of swing arms in a direction toward a camshaft; and a plurality of latching mechanisms for selectively latching the plurality of swing arms, wherein, in the housing, a plurality of lash adjuster receiving indentations that receive the plurality of lash adjusters are formed, at least one valve receiving indentation for receiving a valve is formed at an opposite side of the plurality of lash adjuster receiving indentations, and a plurality of oil passages for supplying oil from the plurality of lash adjuster receiving indentations to the plurality of latching mechanisms are formed.

The plurality of latching mechanisms may include at least one of latching mechanisms maintaining a latched position when not operated, and at least one of latching mechanisms maintaining an unlatched position when not operated.

The plurality of swing arms may be provided with a roller or a pad at a portion contacting, a cam.

The plurality of swing arms may include a first swing arm and second and third swing arms respectively arranged at left and right sides of the first swing arm, and the plurality of latching mechanisms may include first, second, and third latching mechanisms for respectively latching the first, second, and third swing arms.

The plurality of lash adjuster receiving indentations may include the first lash adjuster receiving indentation and second and third lash adjuster receiving indentations respectively arranged at left and right sides of the first lash adjuster receiving indentation, and the plurality of oil passages may include first, second, and third oil passages that respectively connect the first, second, and third lash adjuster receiving indentations with the first, second, and third latching mechanisms.

The plurality of lash adjuster receiving indentations may include a first lash adjuster receiving indentation for supplying oil to the first latching mechanism, and a second lash adjuster receiving indentation for supplying oil to the second and third latching mechanisms.

The plurality of swing arms may include a first swing arm, second and third swing arms respectively arranged at left and right sides of the first swing arm, and fourth and fifth swing arms respectively arranged at a left side of the second swing arm and at a right side of the third swing arm. The plurality of latching mechanisms may include first, second, third, fourth, and fifth latching mechanisms for respectively latching the first, second, third, fourth, and fifth swing arms.

The plurality of lash adjuster receiving indentations may include the first, second, and third lash adjuster receiving indentations. The plurality of oil passages may include: a first oil passage connecting the first lash adjuster receiving indentation with the first latching mechanism; second and third oil passages connecting the second lash adjuster receiving indentation with the second and third latching mechanisms; and fourth and fifth oil passages connecting the third lash adjuster receiving indentation with the fourth and fifth latching mechanisms.

The lash adjuster may be a hydraulic lash adjuster.

The lash adjuster malt be a mechanical lash adjuster.

The oil pipe may be arranged at a lateral side of the lash adjuster.

The oil pipe may be arranged below the lash adjuster.

An oil delivery passage for delivering oil from the oil pipe to the rocker arm may be formed inside the lash adjuster.

Such a VVL, apparatus may further include a motor connected with the oil pipe, wherein a plurality of oil supply holes for supplying oil to the plurality of lash adjusters are formed at an exterior circumference of the oil pipe, and the plurality of oil supply holes include a plurality of penetration holes formed at the exterior circumference of the oil pipe with different angular positions.

The plurality of oil supply holes may include a plurality of penetration holes formed at the exterior circumference of the oil pipe with the same angular position.

According to the exemplary rocker arm and VVL apparatus, a variable valve lift may be achieved in a very simple scheme, and a small-size and high-performance engine may be realized. Furthermore, a cylinder deactivation function can be achieved by the VVL apparatus.

BRIEF DESCRIPTION OF THE DRAWINGS

The above and other features of the present invention will now be described in detail with reference to certain exemplary embodiments thereof illustrated the accompanying drawings which are given hereinbelow by way of illustration only, and thus are not limitative of the present invention, and wherein.

Figure 1:
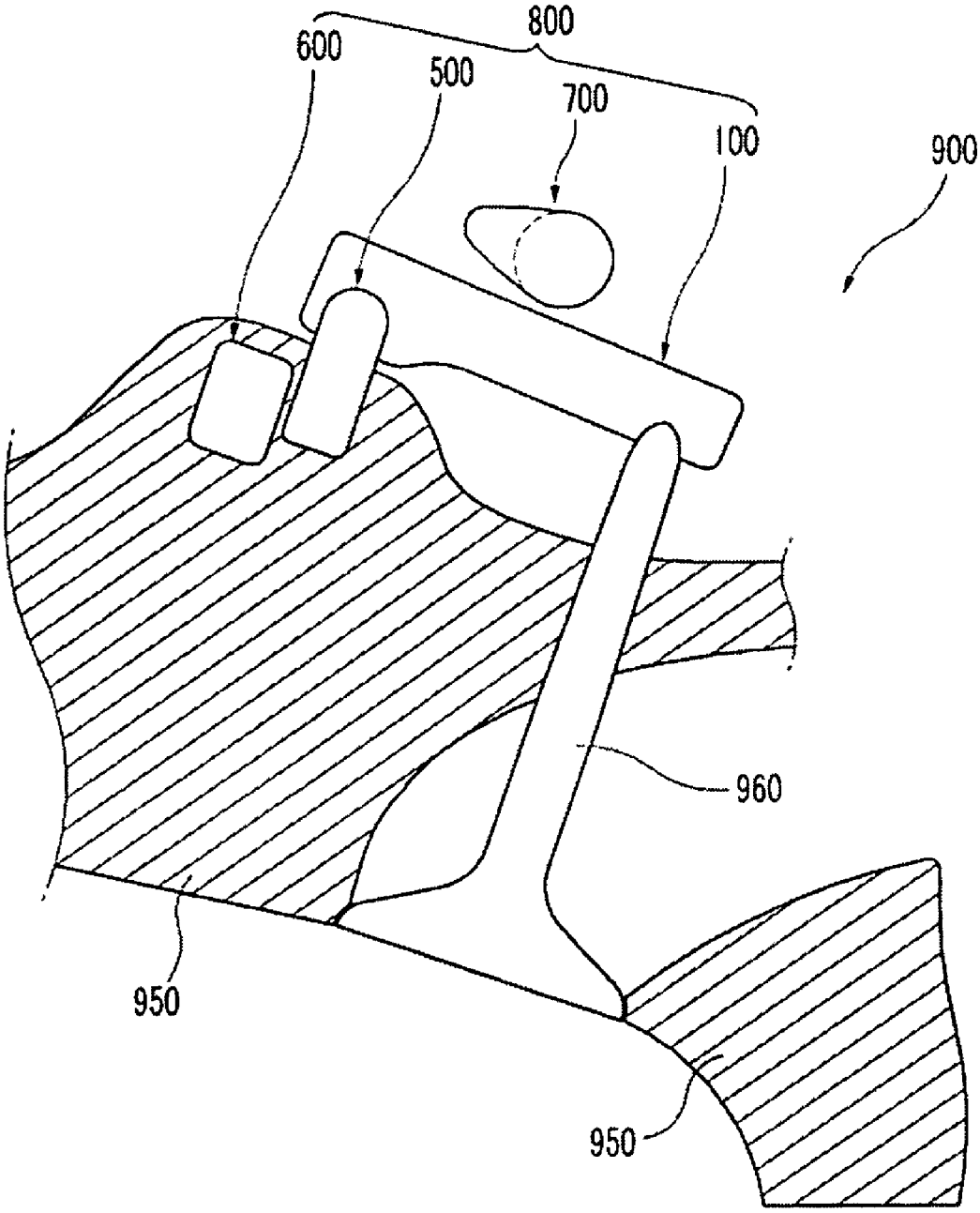
FIG. 1 is a schematic diagram that shows an engine according to an exemplary embodiment of the present invention.

In the figures, reference numbers refer to the same or equivalent parts of the present invention throughout the several figures of the drawing.

REPRESENTATIVE REFERENCE NUMERALS

100, 200, 300: rocker arm

110, 120, 130, 310, 320, 330, 340, 350: swing arm

111, 121, 131: side catching protrusion
113: roller
114*a*, 114*b*, 134*a*, 134*b*, 124*a*, 124*b*, 930: spring
115, 125, 135: lower catching projection
117, 127, 137, 217, 227, 317, 327, 337: lash adjuster receiving indentation
118, 128, 138, 218, 228, 238, 318, 328, 338, 348, 359: oil passage
119, 129, 139, 319, 329, 339, 349, 359: latching mechanisms
123, 133: pad
140: contact pad
150, 360: housing
160: mounting shaft
190: valve receiving indentation
500: lash adjuster unit
510, 520, 530: lash adjuster
512, 519: oil hole
600: oil control unit
700: camshaft
710, 720, 730: cam
800: VVL, apparatus
870: fixed pipe
880: oil pipe
881, 882: penetration hole
890: motor
900: engine
910: body
920: plunger
940: stopper
950: space
950: cylinder head
960: valve

DETAILED DESCRIPTION OF THE EMBODIMENTS

Hereinafter reference will now be made in detail to various embodiments of the present invention, examples of which are illustrated in the accompanying drawings and described below. While the invention will be described in conjunction with exemplary embodiments, it will be understood that present description is not intended to limit the invention to those exemplary embodiments. On the contrary, the invention is intended to cover not only the exemplary embodiments, but also various alternatives, modifications, equivalents and other embodiments, which may be included within the spirit and scope of the invention as defined by the appended claims.

FIG. 1 is a schematic diagram that shows an engine according to an exemplary embodiment of the present invention.

A VVL apparatus 800 according to an exemplary embodiment of the present invention operates a valve 960 of an engine 900 at a plurality of lifts.

As shown in FIG. 1, the VVL apparatus 800 includes: a camshaft 700 having a plurality of cams of different profiles for each cylinder; a lash adjuster unit 500 arranged at a cylinder head 950 of the engine 900; an oil control unit 600 that is arranged at the cylinder head 950 and supplies oil to the lash adjuster unit 500; and a rocker arm 100 that drives the valve 960 at a plurality of lifts when the camshaft 700 is operated.

The lash adjuster unit 500 includes a plurality of lash adjusters 510, 520, and 530 (refer to FIGS. 8 and 9) for each cylinder.

The plurality of lash adjusters may be formed as hydraulic lash adjusters or mechanical lash adjusters.

Figure 8:
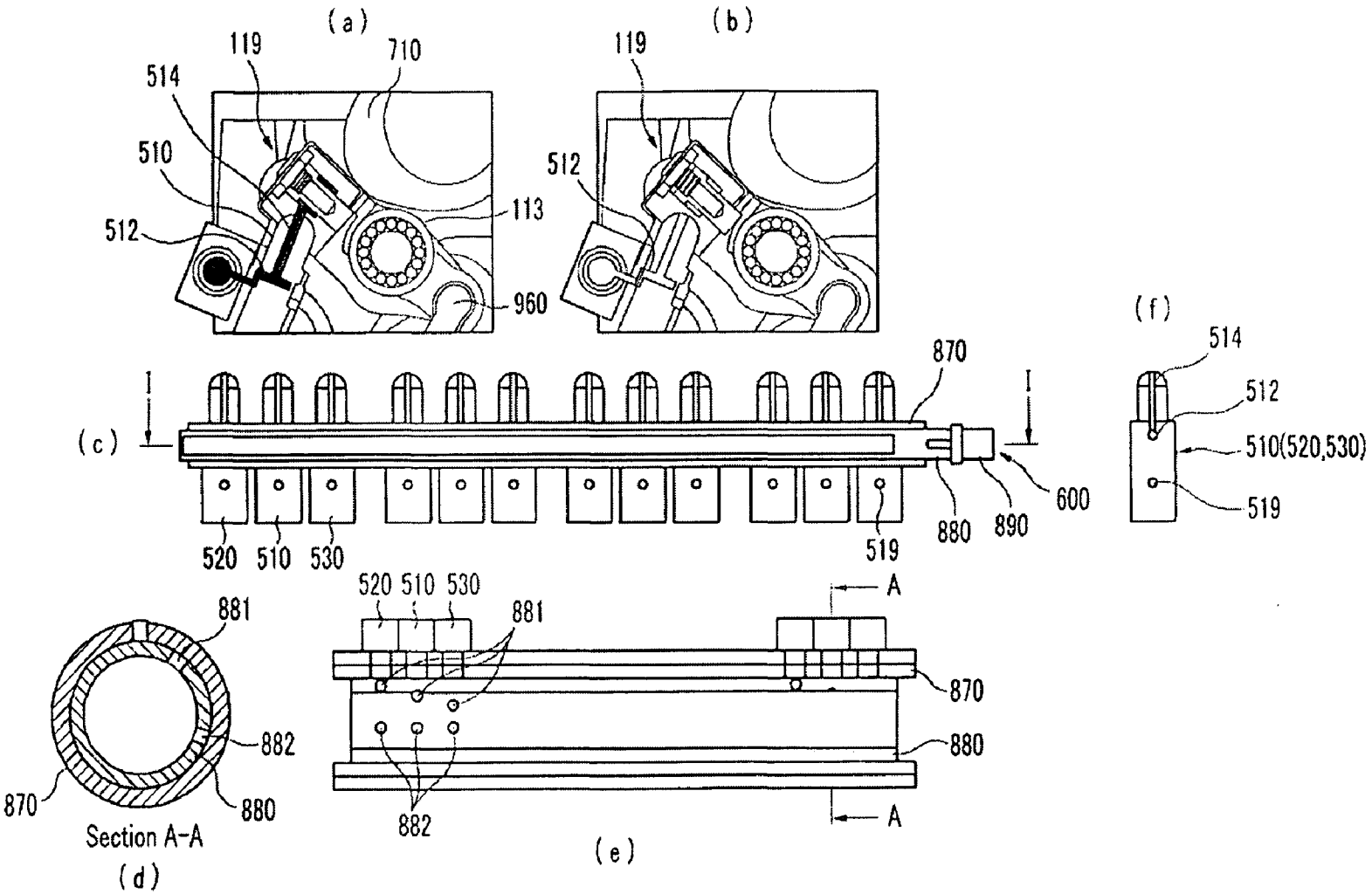
FIG. 8 shows configuration and operation of a VVL apparatus according to an exemplary embodiment of the present invention.
Figure 9:
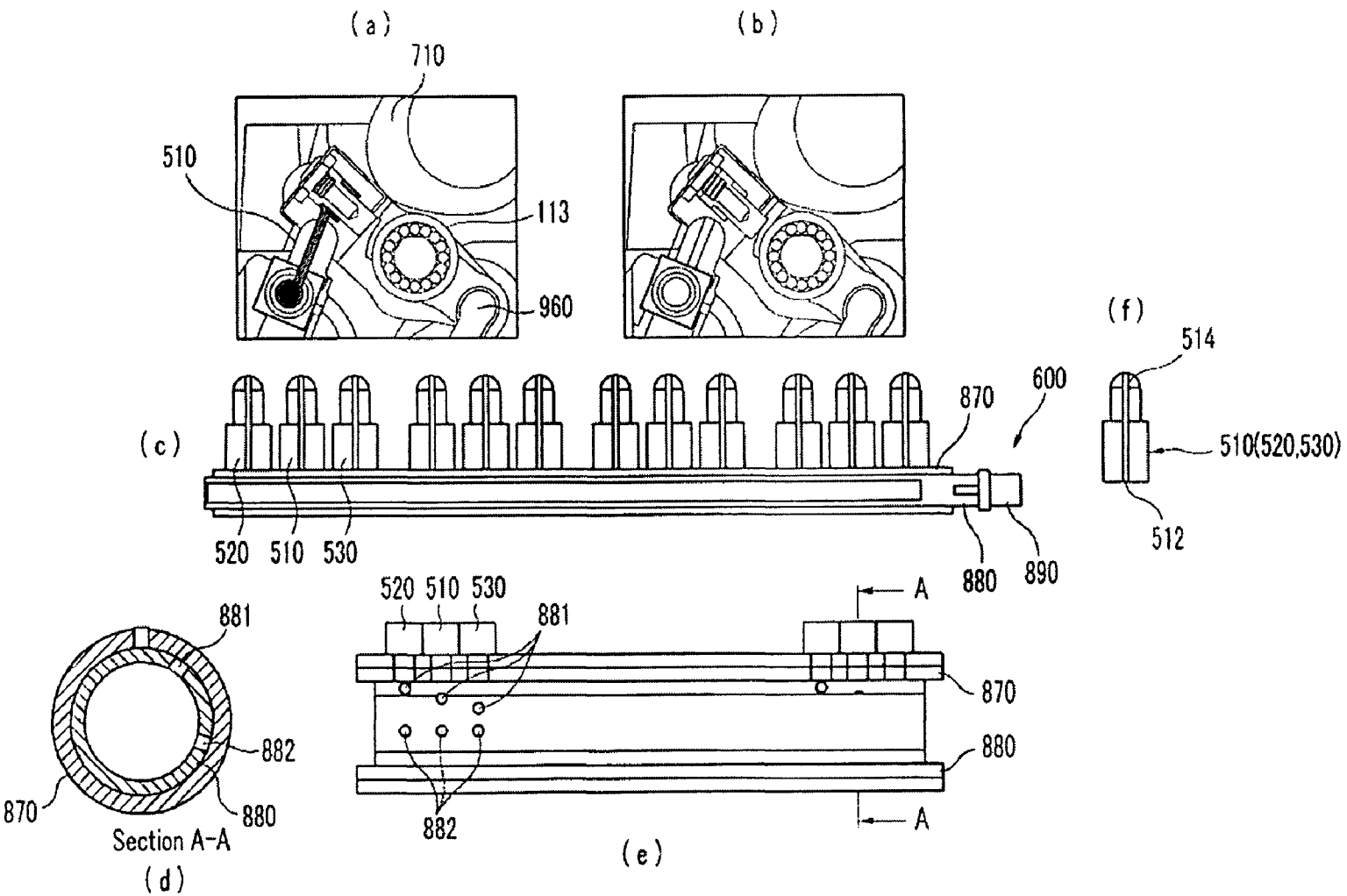
FIG. 9 shows configuration and operation of a VVL apparatus according to another exemplary embodiment of the present invention.

The oil control unit 600 includes an oil pipe 880 formed in the cylinder head so as to supply oil to lash adjuster unit 500 (refer to FIG. 8 or FIG. 9).

Hereinafter, a rocker arm 100 according to an exemplary embodiment of the present invention will be described in detail with reference to FIG. 2 to FIG. 4.

Figure 2:
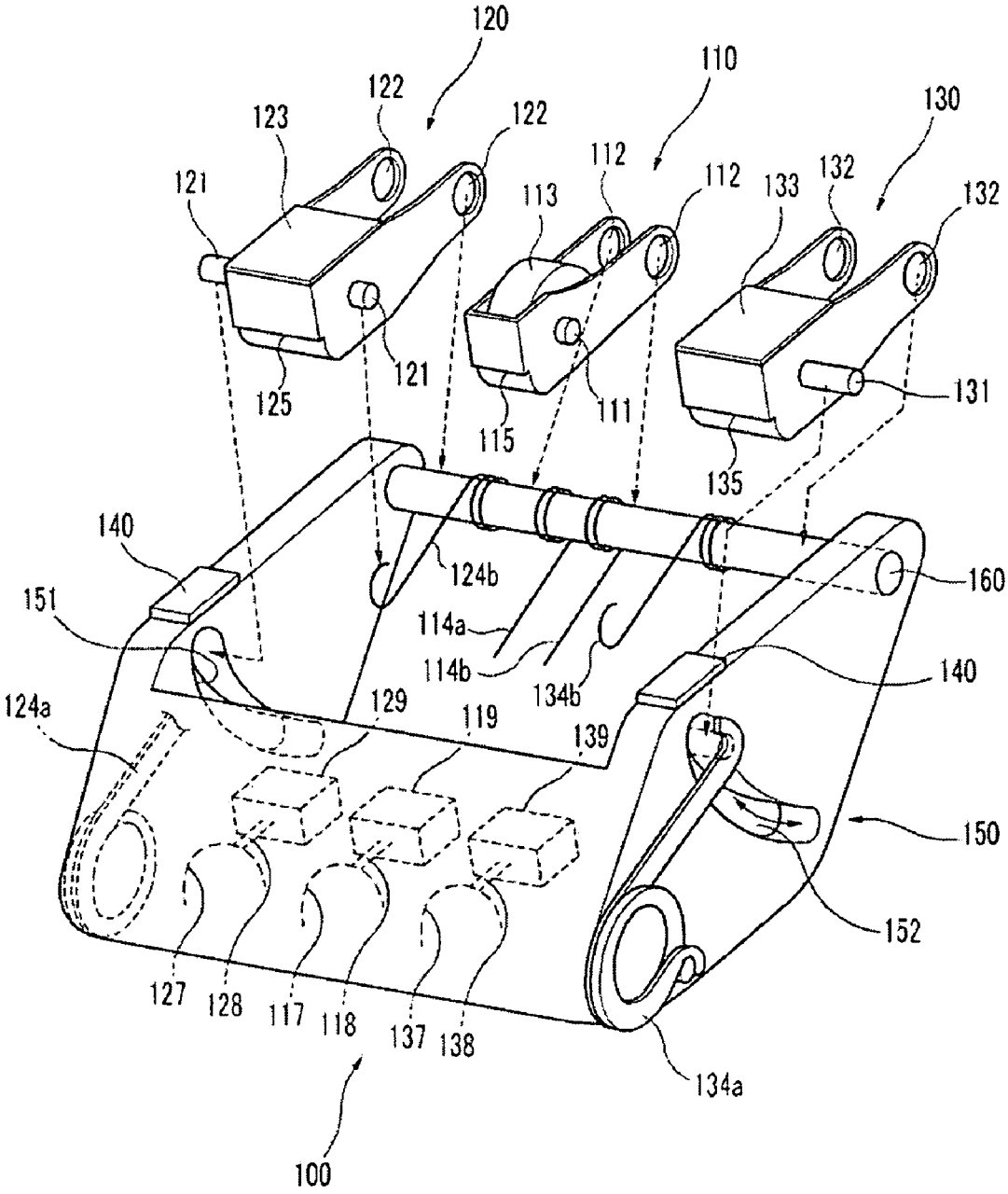
FIG. 2 is a perspective view of a rocker arm according to an exemplary embodiment of the present invention.
Figure 3:
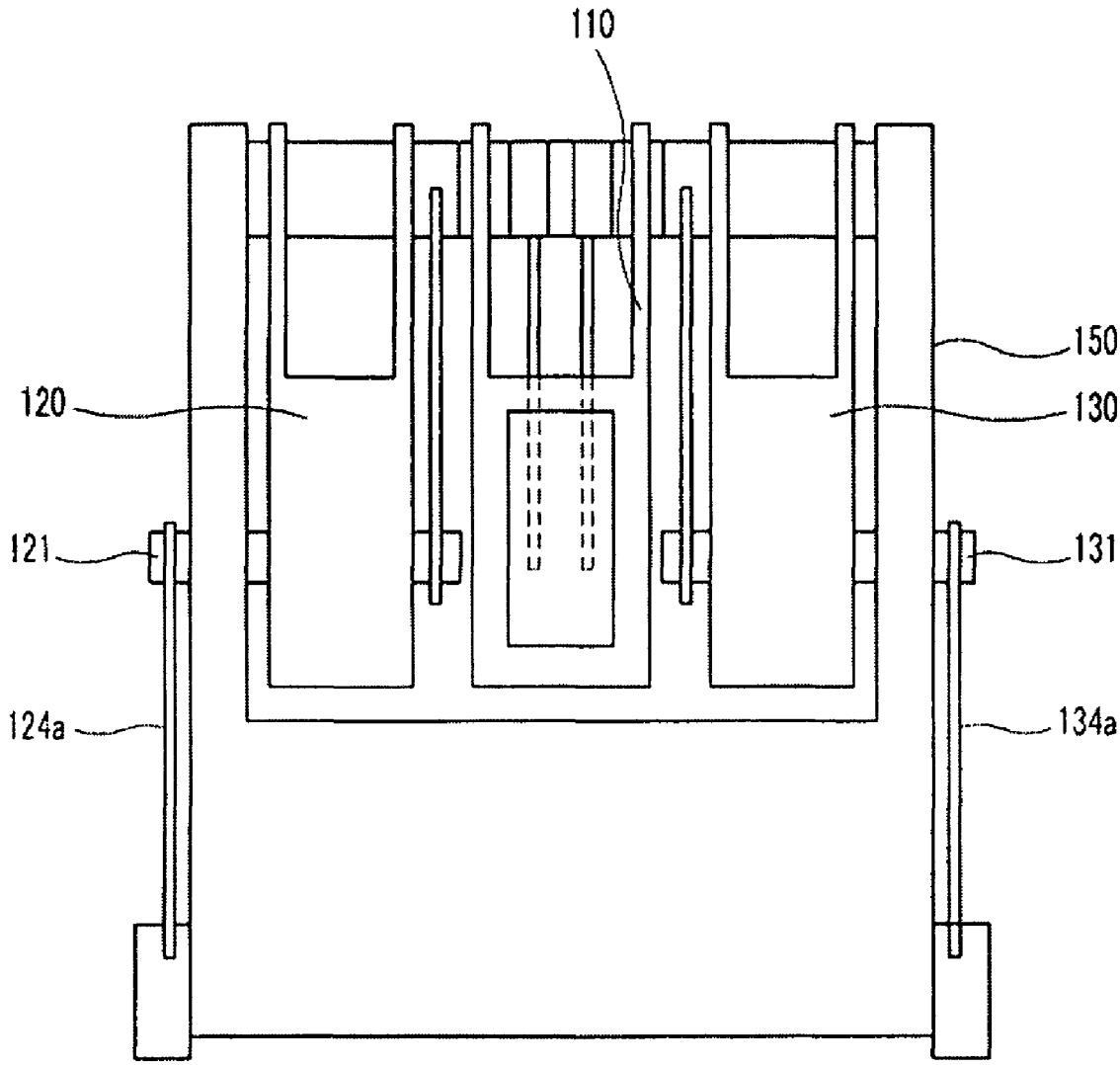
FIG. 3 is a top plan view of a rocker arm according to an exemplary embodiment of the present invention.

FIG. 2 is a perspective view of a rocker arm 100 according to an exemplary embodiment of the present invention. FIG. 3 is a top plan view of a rocker arm 100 according to an exemplary embodiment of the present invention. FIG. 4 is a bottom plan view of a rocker arm 100 according to an exemplary embodiment of the present invention.

As shown in the drawings, a rocker arm 100 according to an exemplary embodiment of the present invention includes: a housing 150; a plurality of swing arms 110, 120, and 130 rotatably arranged at the housing 150; a plurality of springs 114*a*, 114*b*, 124*a*, 124*b*, 134*a*, and 134*b* that apply elastic force to the plurality of swing arms 110, 120, and 130 in a direction of the camshaft 700; and a plurality of latching mechanisms 119, 129, and 139 for selectively latching the plurality of swing arms 110, 120, and 130.

The plurality of latching mechanisms 119, 129, and 139 are formed inside the housing 150, which will be described in detail later.

A plurality of lash adjuster receiving indentations 117, 127, and 137 that receive the plurality of lash adjusters 510, 520, and 530 respectively (refer to FIG. 8) are formed at the bottom of the housing 150.

At least one valve receiving indentation 190 (refer to FIG. 4) for receiving the valve 960 is formed at an opposite side of the plurality of lash adjuster receiving indentations 117, 127, and 137.

Figure 4:
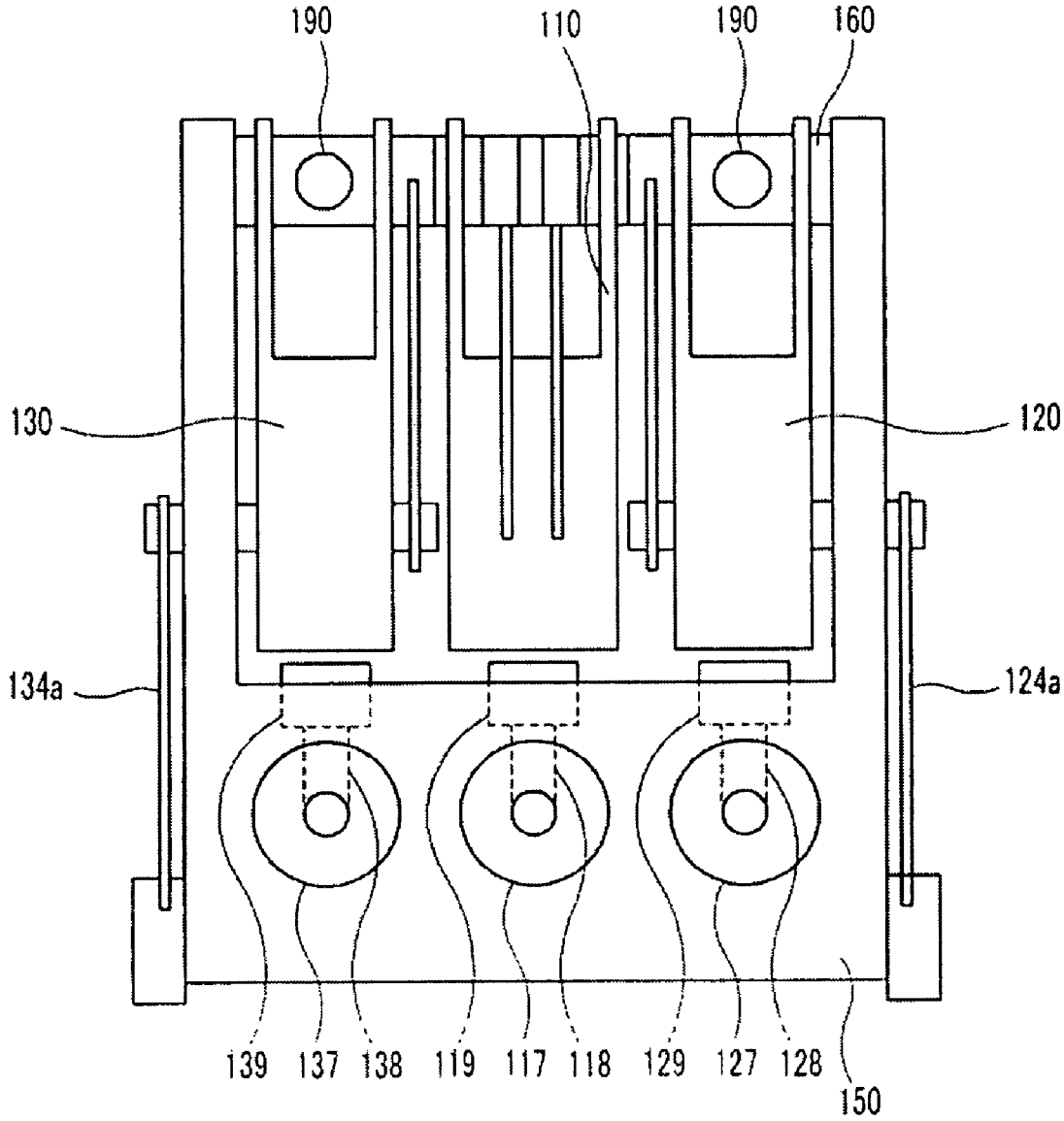
FIG. 4 is a bottom plan view of a rocker arm according to an exemplary embodiment of the present invention.

FIG. 4 illustrates two valve receiving indentations 190, but it should be understood that the present invention is not limited thereto. Although FIG. 4 exemplifies a two-valve engine (i.e., an engine having two intake valves and/or two exhaust valves per cylinder), it should be understood that a single valve receiving indentation may be formed for each valve in the case of a single valve engine. In addition, when there are more than two intake and/or exhaust valves per cylinder, the valve receiving indentations may be formed in a number corresponding to the number of valves.

In addition, a plurality of oil passages 118, 128, and 138 for supplying oil from the plurality of lash adjuster receiving indentations 117, 127, and 137 to the plurality of latching mechanisms 119, 129, and 139 are formed at the housing 150.

In further detail, the plurality of swing arms include first, second, and third swing arms 110, 120, and 130. The second and third swing arms 120 and 130 are respectively arranged at left and right sides of the first swing arm 110. The first, second, and third swing arms 110, 120, and 130 are pivotally mounted on a mounting shalt 160 through penetration holes 112, 122, and 132, respectively.

Each of the first, second, and third swing arms 110, 120, and 130 may be formed as a pad type or a roller type. That is, a pad or a roller may be formed to the first, second, and third swing arms 110, 120, and 130 at a location where cams 710, 720, and 730 (refer to FIG. 7) of the camshaft 700 contact them respectively.

Figure 7:
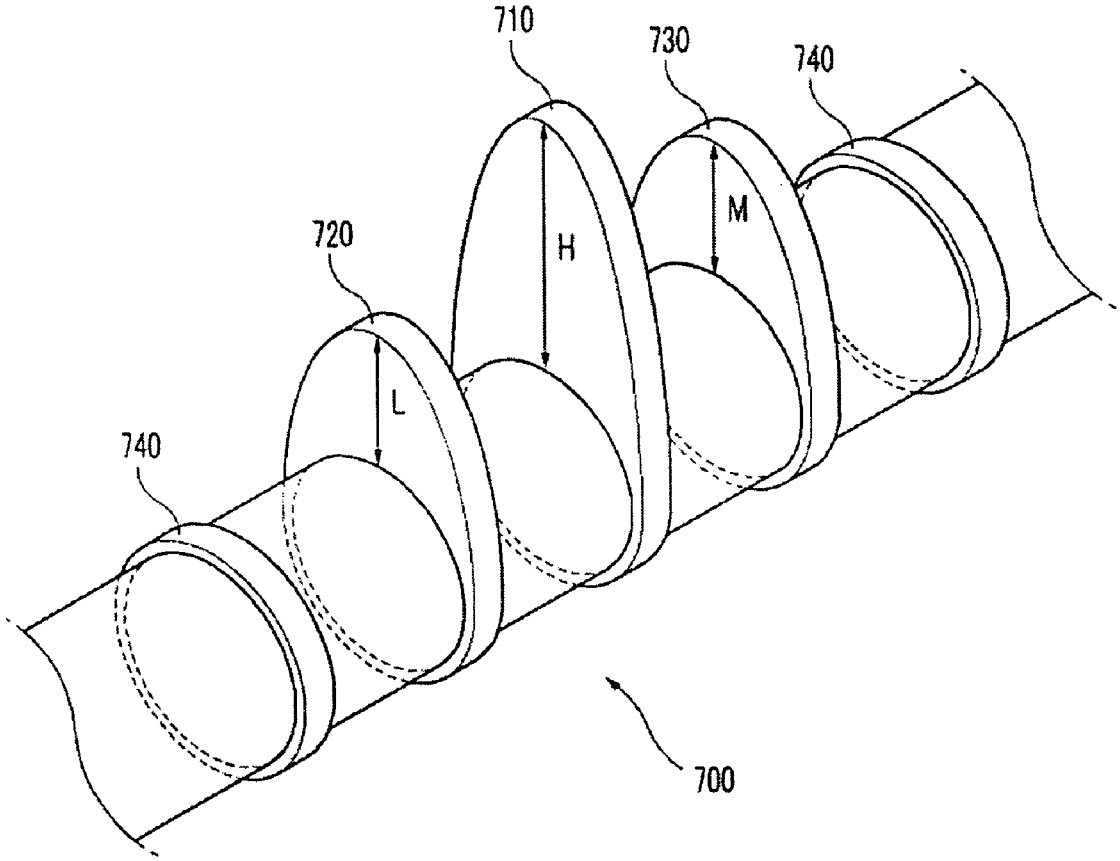
FIG. 7 is a perspective view of a camshaft according to an exemplary embodiment of the present invention.

As an example, according to the rocker arm 100 of the present embodiment, the first swing arm 110 is a roller type, and a roller 113 is provided at a location where a first cam 710 contacts it. The second swing arm 120 is a pad type, and a pad 123 is provided at a location where a second cam 720 contacts it. The third swing arm 130 is a pad type, and a pad 133 is provided at a location where a third cam 730 contacts it. The camshaft 700 shown in FIG. 7 is arranged above the rocker arm 100, and the first, second, and third swing arms 110, 120, and 130 are operated by the first, second, and third cams 710, 720, and 730 from above.

Base circle portions 740 are formed at the front and rear portion of the camshaft 700 wherein the first, second, and third cams 710, 720, and 730 are positioned between the base circle portions 740. The base circle portions 740 of the camshaft 700 contacts contact pads 140 of the housing 150. The contact pads 140 are formed on both upper portions of the housing 150 and support the base circle portions 740 of the camshaft 700.

The first, second, and third swing arms 110, 120, and 130 are respectively provided with a spring so as to always receive an elastic force in a direction toward the camshaft 700. In more detail, as shown in FIG. 2, the first swing arm 110 is coupled to a pair of springs 114*a* and 114*b* through side catching protrusions 111. The second swing arm 120 is coupled to a pair of springs 124*a* and 124*b* through side catching protrusions 121, wherein one of the side catching protrusions 121 is inserted into a slot 151 formed at a lateral side of the housing 150. In addition, the third swing arm 130 is coupled to a pair of springs 134*a* and 134*b* through side catching protrusions 131, wherein one of the side catching protrusions 131 is inserted into a slot 152 formed at other lateral side of the housing 150.

The slots 151 and 152 is configured to support pivotally the second and third swing arms 120, and 130 with respect to the mounting shaft 160.

The first, second, and third swing arms 110, 120, and 130 are provided with lower catching projections 115, 125, and 135 for enabling a latching function as explained in detail later.

The plurality of latching mechanisms include first, second, and third latching mechanisms 119, 129, and 139 for respectively latching the first, second, and third swing arms 110, 120, and 130. That is, the first latching mechanism 119 is formed at a location corresponding to the first swing arm 110 and latches the same. The second and third latching mechanisms 129 and 119 are respectively formed at left and right sides of the first latching mechanism 119, and respectively latch the second and third swing arms 120 and 130.

The plurality of lash adjuster receiving indentations include first, second, and third lash adjuster receiving indentations 117, 127, and 137. The second and third lash adjuster receiving indentations 127 and 137 are respectively arranged at left and right sides of the first lash adjuster receiving indentation 117.

The plurality of oil passages include first, second, and third oil passages 118, 128, and 138 that respectively connect the first, second, and third lash adjuster receiving indentations 117, 127, and 137 with the first, second, and third latching mechanisms 119, 129, and 139. That is, the first oil passage 118 connects the first lash adjuster receiving indentation 117 with the first latching mechanism 119, the second oil passage 128 connects the second lash adjuster receiving indentation 127 with the second latching mechanism 129, and the third oil passage 138 connects the third lash adjuster receiving indentation 137 with the third latching mechanism 139.

The number and configuration of the lash adjuster receiving indentations and connections of the lash adjuster receiving indentations with the latching mechanisms may be varied in various ways, which is later described in detail.

As the latching mechanism, a latching mechanism maintaining a latched position when not operated or a latching mechanism maintaining an unlatched position when not operated may be employed.

Figure 5:
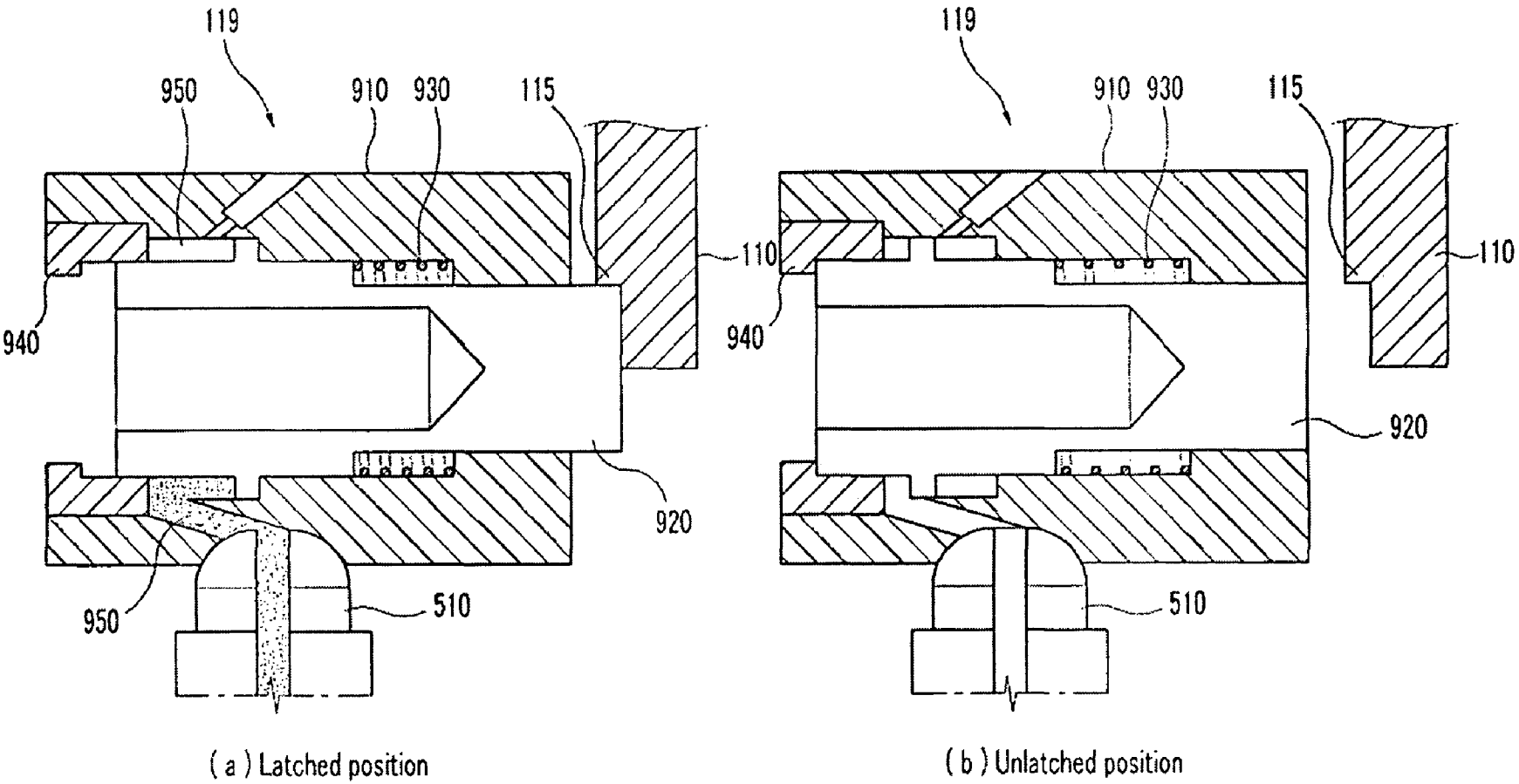
FIG. 5 illustrates an operation of a latching mechanism maintaining an unlatched position when not operated.
Figure 6:
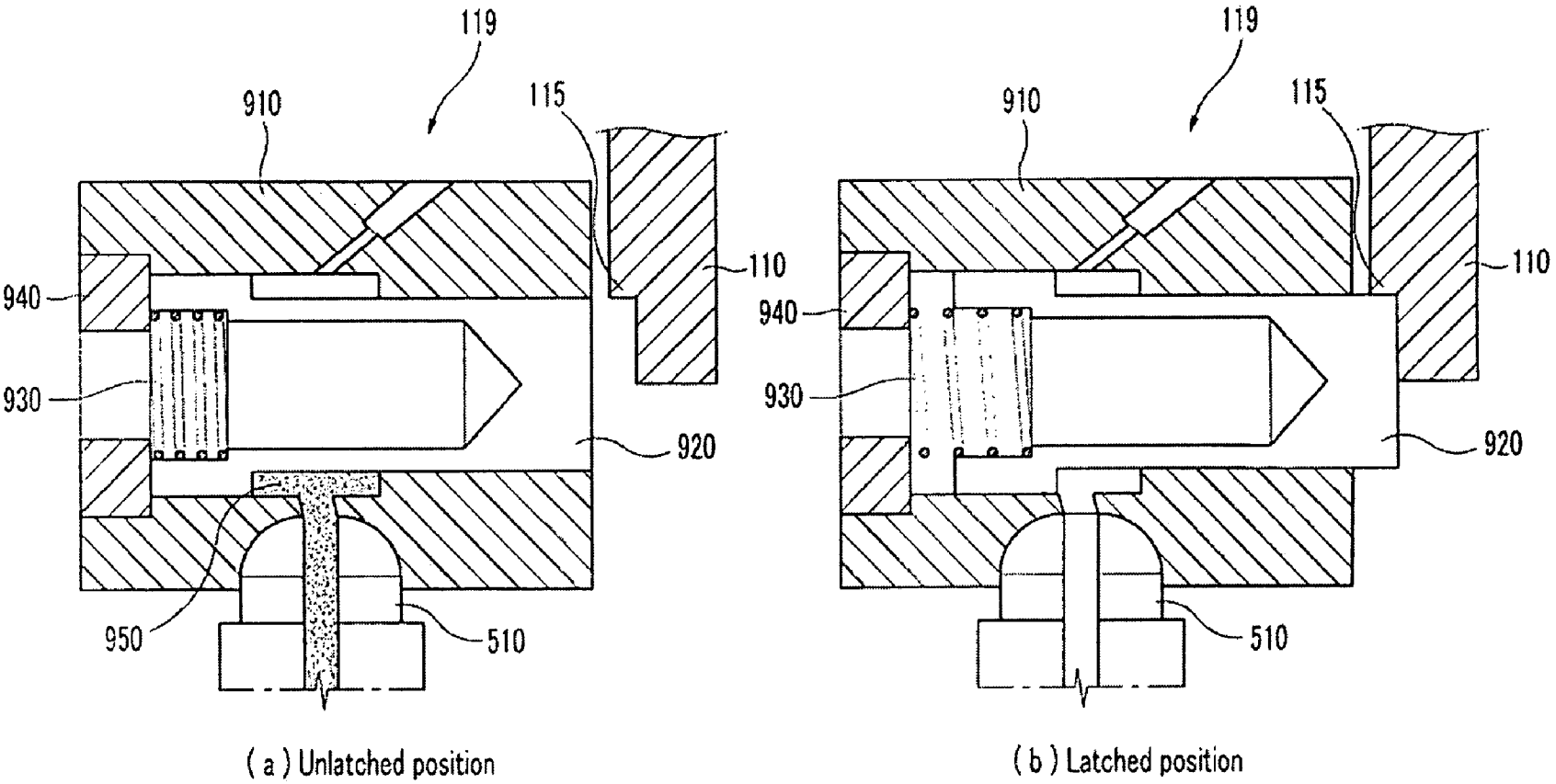
FIG. 6 illustrates an operation of a latching mechanism maintaining a latched position when not operated.

FIG. 5 illustrates an operation of a first latching mechanism 119 maintaining an unlatched position of the first swing arm 110 when not operated as an exemplary embodiment of the present invention. FIG. 6 illustrates an operation of a first latching mechanism 119 maintaining a latched position of the first swing arm 110 when not operated as an exemplary embodiment of the present invention.

Referring to FIG. 5, a plunger 920 is arranged in a body 910 of a first latching mechanism 119, and a space 950 is formed between the body 910 and the plunger 920 so as to allow inflow of oil therein. A spring 930 is coupled to the plunger 920 at a side facing the swing arm 110 so that the plunger 920 is pushed in a direction opposite to the swing arm 110. Therefore, as shown in FIG. 5 (*b*), the plunger 920 moves to the left in the drawing until reaching a position of a stopper 940 when not operated, and latching is released from the lower catching protrusion 115 of the swing arm 110. When oil is supplied into the space 950 through the lash adjuster 510, the plunger 920 moves to the right in the drawing by oil pressure, and the plunger 920 is latched with the lower catching protrusion 115 of the swing arm 110.

Referring to FIG. 6, a plunger 920 is arranged in a body 910 of a first latching mechanism 119, and a space 950 is formed between the body 910 and the plunger 920 so as to allow inflow of oil therein. A spring 930 is coupled to a rear portion of the plunger 920 so that the plunger 920 is pushed toward the swing arm 110. Therefore, as shown in FIG. 6 (*b*), the plunger 920 moves, when not operated, to the right in the drawing so as to latch the lower catching protrusion 115 of the swing arm 110. When oil is supplied into the space 950 through the lash adjuster 510 as shown in FIG. 6(*a*), the plunger 920 moves to the left in the drawing by oil pressure until reaching a position of a stopper 940, and latching is released from the lower catching protrusion 115 of the swing arm 110.

As an example, the second, and third latching mechanisms 129, and 139 according to an exemplary embodiment of the present invention may be formed as a latching mechanism maintaining a latched position when not operated.

However, it should be understood that the scope of the present invention is not limited thereto. Some of the first, second, and third latching mechanisms 119, 129, and 139 may be formed as a latching mechanism maintaining a latched position when not operated, and others may be formed as a latching mechanism maintaining an unlatched position when not operated. In addition, all of the first, second, and third latching mechanisms 119, 129, and 139 may be formed as a latching mechanism maintaining an unlatched position when not operated. With regard to the above variations of latching mechanism in connection with non-operated states, required variation to other constitutions is obviously understood by a person of ordinary skill in the art.

FIG. 8 shows configuration and operation of a VVL apparatus according to an exemplary embodiment of the present invention.

As shown in FIG. 8 (*c*), the lash adjuster unit 500 includes first, second, and third lash adjusters 510, 520, and 530 per cylinder. In an exemplary embodiment of the present invention, the first, second, and third lash adjusters 510, 520, and 530 are respectively formed as hydraulic lash adjusters.

As shown in FIG. 8 (*f*), an oil hole 519 for a lash adjusting function is formed in the lash adjuster 510, and an oil hole 512 for a latching function is formed above the oil hole 519. The oil hole 512 is vertically formed to penetrate the lash adjuster 510 wherein the oil hole 512 fluidly communicates with oil hole 514 formed in a length direction of the lash adjuster 510. Therefore, when oil is supplied to the oil hole 512, the first latching mechanism 119 is supplied with the oil through the lash adjuster 510, and thus the latching mechanism 119 is operated. The second and third lash adjusters 520 and 530 are formed in the same way as the first lash adjuster 510.

FIG. 8 (*c*) is a cross-sectional view along a line I-I of FIG. 8 (*c*) and FIG. 8 (*d*) is a cross-sectional view along a line A-A of FIG. 8 (*f*).

As shown in FIG. 8 (*c*), FIG. 8 (*d*), and FIG. 8 (*e*), the oil control unit 600 includes a fixed pipe 870, an oil pipe 880 that is formed in the cylinder head 950 and supplies oil to the plurality of lash adjusters 510, 520, and 530, and a housing 885.

Oil is externally supplied to the oil pipe 880 through an input port (not shown).

A plurality of penetration holes 881 and 882 are formed at a portion around the oil pipe 880 so as to supply oil to the plurality of lash adjusters 510, 520, and 530. The oil pipe 880 is arranged inside a fixed pipe 870 that is fixed to the housing 885. The housing 885 is coupled to the cylinder head 950, and the oil pipe 880 is rotatable by a motor 890. The oil pipe 880 is arranged at a lateral side of the lash adjusters 510, 520, and 530.

In this configuration, when a penetration hole 881 or 882 of the oil pipe 880 coincides with an oil hole 512 of a specific lash adjuster among the lash adjusters 510, 520, and 530 according to rotation of the oil pipe 880 by the motor 890, a latching mechanism corresponding to the specific lash adjuster is operated.

Therefore, various valve operations of each cylinder may be enabled by designing positions of the penetration holes on the oil pipe 880.

For example, a valve of a specific cylinder may be driven at a high lift or a low lift. In addition, a specific cylinder may be deactivated by enabling the valve of the specific cylinder to always be closed.

According to the present exemplary embodiment, the penetration holes 881 are formed at different angular positions on an exterior circumference of the oil pipe 880. In addition, the penetration holes 882 are formed at the same angular position on an exterior circumference of the oil pipe 880 along the longitudinal direction thereon.

Accordingly, respective angular length between the penetration holes 881 and 882 determines the lift amount of the first, second, and third swing arms 110, 120 and 130.

FIG. 9 shows configuration and operation of a VVL apparatus according to another exemplary embodiment of the present invention.

FIG. 9 (*e*) is a cross-sectional top view of FIG. 9(*c*) and FIG. 9 (*d*) is a cross-sectional view along a line B-B of FIG. 9 (*f*).

As shown in FIG. 9 (*c*), the lash adjuster unit 500 includes first, second, and third lash adjusters 510, 520, and 530 per cylinder. In the present exemplary embodiment, the first, second, and third lash adjusters 510, 520, and 530 are respectively formed as mechanical lash adjusters.

As shown in FIG. 9 (*f*), an oil hole 512 for a latching function is formed in the lash adjuster 510. The oil hole 512 is formed to penetrate the lash adjuster 510 in a length direction. Therefore, when oil is supplied to the oil hole 512, the first latching mechanism 119 is supplied with the oil through the lash adjuster 510, and thus the latching mechanism 119 is operated. The second and third lash adjusters 520 and 530 are formed in the same way as the first lash adjuster 510.

As shown in FIG. 9 (*c*), FIG. 9 (*d*), and FIG. 9 (*e*), the oil control unit 600 includes an oil pipe 880 that is formed in the cylinder head 950 and supplies oil to the plurality of lash adjusters 510, 520, and 530 through oil hole 512.

A plurality of penetration holes 881 and 882 are formed at the oil pipe 880 so as to supply oil to the plurality of lash adjusters 510, 520, and 530. The oil pipe 880 is arranged inside a fixed pipe 870 fixed to the cylinder head 950 via a housing 885, and is rotatable by a motor 890. The oil pipe 880 is arranged at a lower side of the lash adjusters 510, 520, and 530.

Therefore, when a penetration hole of the oil pipe 880 coincides with an oil hole 512 of a specific lash adjuster among the lash adjusters 510, 520, and 530 according to rotation of the oil pipe 880 by the motor 890, a latching mechanism corresponding to the specific lash adjuster is operated.

Therefore, various valve operations of each cylinder may be enabled by designing positions of the penetration holes on the oil pipe 880.

For example, a valve of a specific cylinder may be driven at a high lift or a low lift. In addition, a specific cylinder may be deactivated by enabling the valve of the specific cylinder to always be closed.

According to the present exemplary embodiment, the penetration holes 881 are formed at different angular positions on an exterior circumference of the oil pipe 880. In addition, the penetration holes 882 are formed at the same angular position on an exterior circumference of the oil pipe 880 along the longitudinal direction thereon.

Various cylinder operating states that can be enabled by an exemplary embodiment of the present invention are shown in the following table. In the following table, Group 1 includes first and fourth cylinders and Group 2 includes second and third cylinders, according to a typical naming of cylinders (i.e. first to fourth sequentially from the front of an engine).

The following Table 1 shows cylinder operating states in which the cylinder deactivation function is activated.

TABLE 1

| | | Lift | Group 1 Cyl. #1 | Group 2 Cyl. #2 | Group 2 Cyl. #3 | Group 1 Cyl. #4 |
|---|---|---|---|---|---|---|
| 1 | Group 1: High | H | ○ | | | ○ |
| | Group 2: 0 lift | M | | | | |
| | | L | | | | |
| | | 0 | | ○ | ○ | |
| 2 | Group 1: 0 lift | H | | ○ | ○ | |
| | Group 2: High | M | | | | |
| | | L | | | | |
| | | 0 | ○ | | | ○ |
| 3 | Group 1: | H | | | | |
| | Medium | M | ○ | | | ○ |
| | Group 2: 0 lift | L | | | | |
| | | 0 | | ○ | ○ | |
| 4 | Group 1: 0 lift | H | | | | |
| | Group 2: | M | | ○ | ○ | |
| | Medium | L | | | | |
| | | 0 | ○ | | | ○ |
| 5 | Group 1: Low | H | | | | |
| | Group 2: 0 lift | M | | | | |
| | | L | ○ | | | ○ |
| | | 0 | | ○ | ○ | |
| 6 | Group 1: 0 lift | H | | | | |
| | Group 2: Low | M | | | | |
| | | L | | ○ | ○ | |
| | | 0 | ○ | | | ○ |
| 7 | Group 1: 0 lift | H | | | | |
| | Group 2: 0 lift | M | | | | |
| | | L | | | | |
| | | 0 | ○ | ○ | ○ | ○ |

The following Table 2 shows cylinder operating states in which the cylinder deactivation function is not activated.

TABLE 2

| | | Lift | Group 1 Cyl. #1 | Group 2 Cyl. #2 | Group 2 Cyl. #3 | Group 1 Cyl. #4 |
|---|---|---|---|---|---|---|
| 1 | All cyl. High | H | ○ | ○ | ○ | ○ |
| | | M | | | | |
| | | L | | | | |
| | | 0 | | | | |
| 2 | All cyl. Medium | H | | | | |
| | | M | ○ | ○ | ○ | ○ |
| | | L | | | | |
| | | 0 | | | | |
| 3 | All cyl. Low | H | | | | |
| | | M | | | | |
| | | L | ○ | ○ | ○ | ○ |
| | | 0 | | | | |
| 4 | Group 1: High | H | ○ | | | ○ |
| | Group 2: | M | | ○ | ○ | |
| | Medium | L | | | | |
| | | 0 | | | | |
| 5 | Group 1: | H | | ○ | ○ | |
| | Medium | M | ○ | | | ○ |
| | Group 2: High | L | | | | |
| | | 0 | | | | |
| 6 | Group 1: High | H | ○ | | | ○ |
| | Group 2: Low | M | | | | |
| | | L | | ○ | ○ | |
| | | 0 | | | | |
| 7 | Group 1: Low | H | | ○ | ○ | |
| | Group 2: High | M | | | | |
| | | L | ○ | | | ○ |
| | | 0 | | | | |
| 8 | Group 1: | H | | | | |
| | Medium | M | ○ | | | ○ |
| | Group 2: Low | L | | ○ | ○ | |
| | | 0 | | | | |
| 9 | Group 1: Low | H | | | | |
| | Group 2: | M | | ○ | ○ | |
| | Medium | L | ○ | | | ○ |
| | | 0 | | | | |

In the above description, examples have been described with respect to the case where the number of lash adjuster receiving indentations is identical to the number of swing arms.

In the following description, examples of variations available to the rocker arm according to an exemplary embodiment of the present invention are described.

Figure 10:
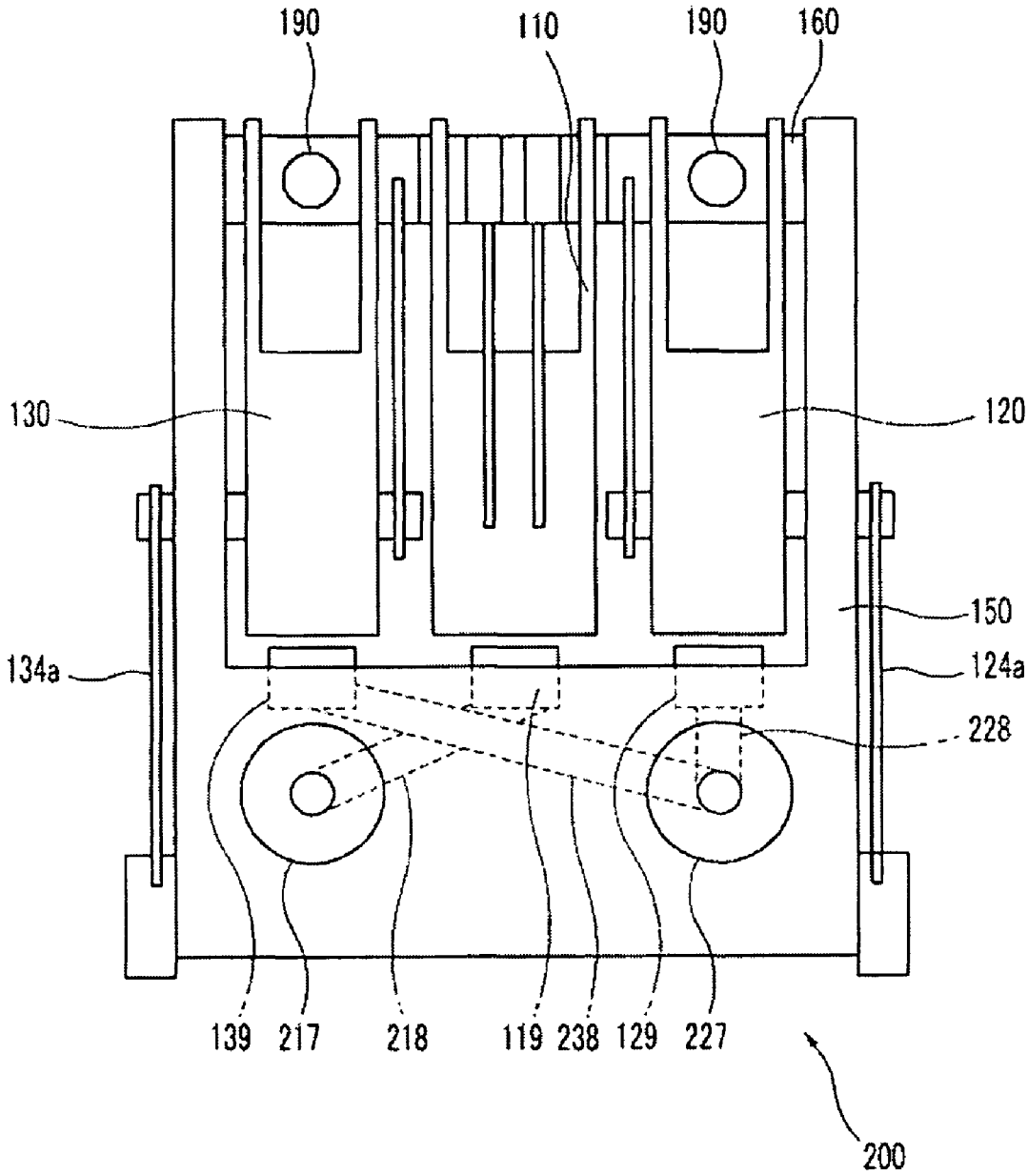
FIG. 10 shows a bottom plan view of a rocker arm according to a second exemplary embodiment of the present invention.

FIG. 10 shows a rocker arm 200 according to a second exemplary embodiment of the present invention.

Regarding a rocker arm 200 according to a second exemplary embodiment of the present invention, an overall features of a housing 150, the first, second, and third swing arms 110, 120, and 130, springs 114*a*, 114*b*, 124*a*, 124*b*, 134*a*, and 134*b*, latching mechanisms 119, 129, and 139, and valve receiving indentations 190 are the same as the rocker arm 100 according to the first exemplary embodiment of the present invention.

In the rocker arm 200 according to a second exemplary embodiment of the present invention, the plurality of lash adjuster receiving indentations include a first lash adjuster receiving indentation 217 for supplying oil to the first latching mechanism 119, and a second lash adjuster receiving indentation 227 for supplying oil to the second and third latching mechanisms 129 and 139.

That is, the first lash adjuster receiving indentation 217 is connected with the first latching mechanism 119 by the first oil passage 218, and the second lash adjuster receiving indentation 227 is connected with the second and third latching mechanisms 129 and 139 by the second and third oil passages 228 and 238, respectively.

By such a configuration, either the first swing arm 110 is latched, or the second and third swing arms 120 and 130 are simultaneously latched. Therefore, the rocker arm 200 symmetrically receives operating force when the camshaft 700 rotates.

In a VVL apparatus employing such a rocker arm 200 according to a second exemplary embodiment of the present invention, two lash adjusters are used, and three stages of cylinder operation states (i.e., high, low, and deactivation) are realized.

Figure 11:
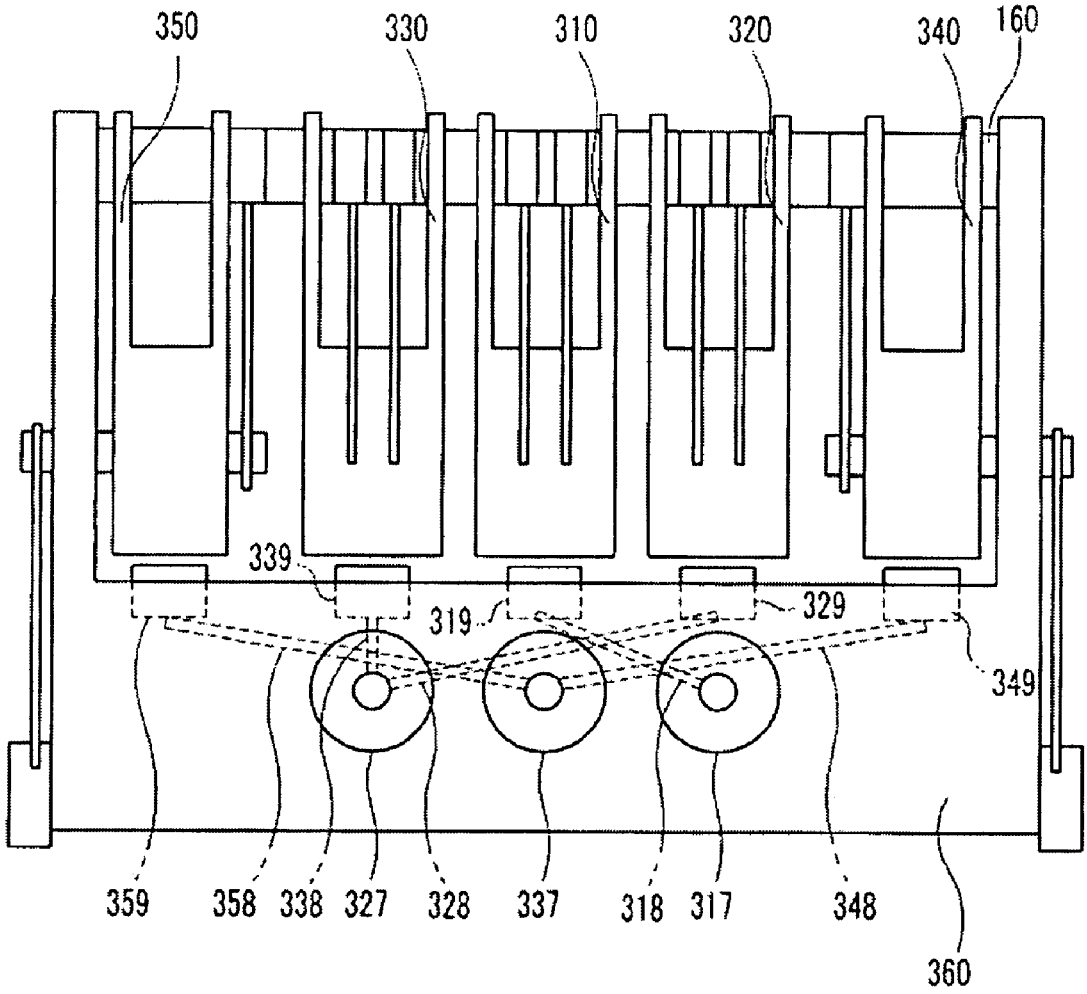
FIG. 11 shows a rocker arm according to a third exemplary embodiment of the present invention.

FIG. 11 shows a rocker arm according to a third exemplary embodiment of the present invention.

A rocker arm 300 according to a third exemplary embodiment of the present invention includes a first swing arm 310, second and third swing arms 320 and 330 arranged at left and right sides of the first swing arm 310, and fourth and fifth swing arms 340 and 350 respectively arranged adjacent to the second and third swing arms 320 and 330.

The rocker arm 300 includes first, second, third, fourth, and fifth latching mechanisms 319, 329, 339, 349, and 359 for respectively latching the first, second, third, fourth, and fifth swing arms 310, 320, 330, 340, and 350. In addition, first, second, and third lash adjuster receiving indentations 317, 327, and 337 are formed at a housing 360 of the rocker arm 300.

The first lash adjuster receiving indentation 317 is connected with the first latching mechanism 319 by a first oil passage 318. The second lash adjuster receiving indentation 327 is connected with the second and third latching mechanisms 329 and 339 by second and third oil passages 328 and 338, respectively. The third lash adjuster receiving indentation 337 is connected with the fourth and fifth latching mechanisms 349 and 359 by the fourth and fifth oil passages 348 and 358, respectively.

By such a configuration, either the first swing arm 310 is latched, the second and third swing arms 320 and 330 are simultaneously latched, or the fourth and fifth swing arms 340 and 350 are simultaneously latched. Therefore, the rocker arm 300 symmetrically receives operating force when the camshaft 700 rotates.

In a VVL apparatus employing such a rocker arm 300 according to a third exemplary embodiment of the present invention, three lash adjusters are used, and four stages of cylinder operations states (i.e., high, medium, low, and deactivation) are realized.

While this invention has been described in connection with what is presently considered to be practical exemplary embodiments, it is to be understood that the invention is not limited to the disclosed embodiments. On the contrary, it is intended to cover various modifications and equivalent arrangements included within the spirit and scope of the appended claims.

What is claimed is:

1. A rocker arm for a variable valve lift apparatus, comprising:

a housing;

a plurality of swing arms rotatably arranged at the housing;

a plurality of springs that apply elastic force to the plurality of swing arms in a direction toward a camshaft; and a plurality of latching mechanisms for selectively latching the plurality of swing arms, wherein, in the housing, a plurality of lash adjuster receiving indentations that receive a plurality of lash adjusters are formed;

at least one valve receiving indentation for receiving a valve is formed at an opposite side of the plurality of lash adjuster receiving indentations; and a plurality of oil passages for supplying oil from the plurality of lash adjuster receiving indentations to the plurality of latching mechanisms are formed;

wherein the plurality of swing arms comprise a first swing arm and second and third swing arms respectively arranged at left and right sides of the first swing arm;

wherein the plurality of latching mechanisms comprise first, second, and third latching mechanisms for respectively latching the first, second, and third swing arms;

wherein the plurality of lash adjuster receiving indentations comprise a first lash adjuster receiving indentation and second and third lash adjuster receiving indentations respectively arranged at left and right sides of the first lash adjuster receiving indentation; and wherein the plurality of oil passages comprise first, second, and third oil passages that respectively connect the first, second, and third lash adjuster receiving indentations with the first, second, and third latching mechanisms.

2. The rocker arm of claim 1, wherein the plurality of latching mechanisms comprise a latching mechanism maintaining a latched position when not operated or a latching mechanism maintaining an unlatched position when not operated.

3. The rocker arm of claim 1, wherein the plurality of swing arms are provided with a roller or a pad at a portion contacting a cam.

4. The rocker arm of claim 1, wherein the plurality of lash adjuster receiving indentations comprise:

a first lash adjuster receiving indentation for supplying oil to the first latching mechanism; and a second lash adjuster receiving indentation for supplying oil to the second and third latching mechanisms.

5. The rocker arm of claim 1, wherein:

the plurality of swing arms comprise a first swing arm, second and third swing arms respectively arranged at left and right sides of the first swing arm, and fourth and fifth swing arms respectively arranged adjacent to the second and third swing arms; and the plurality of latching mechanisms comprise first, second, third, fourth, and fifth latching mechanisms for respectively latching the first, second, third, fourth, and fifth swing arms.

6. The rocker arm of claim 5, wherein the plurality of lash adjuster receiving indentations comprise the first, second, and third lash adjuster receiving indentations, and the plurality of oil passages comprise:

a first oil passage connecting the first lash adjuster receiving indentation with the first latching mechanism;

second and third oil passages connecting the second lash adjuster receiving indentation with the second and third latching mechanisms; and fourth and fifth oil passages connecting the third lash adjuster receiving indentation with the fourth and fifth latching mechanisms.

7. A variable valve lift apparatus for operating a valve of an engine at a plurality of lifts, the variable valve lift apparatus comprising:

a camshaft having a plurality of cams of different profiles for each cylinder;

a plurality of lash adjusters arranged at a cylinder head;

an oil pipe formed in the cylinder head so as to supply oil to the plurality of lash adjusters; and a rocker arm that is arranged below the camshaft and contacts the plurality of lash adjusters and the valve, wherein the rocker arm comprises a housing;

a plurality of swing arms rotatably arranged at the housing;

a plurality of springs that apply elastic force to the plurality of swing arms in a direction toward a camshaft; and a plurality of latching mechanisms for selectively latching the plurality of swing arms;

wherein, in the housing, a plurality of lash adjuster receiving indentations that receive the plurality of lash adjusters are formed;

at least one valve receiving indentation for receiving a valve is formed at an opposite side of the plurality of lash adjuster receiving indentations; and a plurality of oil passages for supplying oil from the plurality of lash adjuster receiving indentations to the plurality of latching mechanisms are formed;

wherein the plurality of swing arms comprise a first swing arm and second and third swing arms respectively arranged at left and right sides of the first swing arm;

wherein the plurality of latching mechanisms comprise first, second, and third latching mechanisms for respectively latching the first, second, and third swing arms;

wherein the plurality of lash adjuster receiving indentations comprise the first lash adjuster receiving indentation and second and third lash adjuster receiving indentations respectively arranged at left and right sides of the first lash adjuster receiving indentation; and wherein the plurality of oil passages comprise first, second, and third oil passages that respectively connect the first, second, and third lash adjuster receiving indentations with the first, second, and third latching mechanisms.

8. The variable valve lift apparatus of claim 7, wherein the plurality of latching mechanisms comprise:

at least one of latching mechanisms maintaining a latched position when not operated; and at least one of latching mechanisms maintaining an unlatched position when not operated.

9. The variable valve lift apparatus of claim 7, wherein the plurality of swing arms are provided with a roller or a pad at a portion contacting a cam.

10. The variable valve lift apparatus of claim 7, wherein the plurality of lash adjuster receiving indentations comprise:

a first lash adjuster receiving indentation for supplying oil to the first latching mechanism; and a second lash adjuster receiving indentation for supplying oil to the second and third latching mechanisms.

11. The variable valve lift apparatus of claim 7, wherein:

the plurality of swing arms comprise a first swing arm, second and third swing arms respectively arranged at left and right sides of the first swing arm, and fourth and fifth swing arms respectively arranged at a left side of the second swing arm and at a right side of the third swing arm; and the plurality of latching mechanisms comprise first, second, third, fourth, and fifth latching mechanisms for respectively latching the first, second, third, fourth, and fifth swing arms.

12. The variable valve lift apparatus of claim 11, wherein the plurality of lash adjuster receiving indentations comprise the first, second, and third lash adjuster receiving indentations, and the plurality of oil passages comprise:

a first oil passage connecting the first lash adjuster receiving indentation with the first latching mechanism;

second and third oil passages connecting the second lash adjuster receiving indentation with the second and third latching mechanisms; and fourth and fifth oil passages connecting the third lash adjuster receiving indentation with the fourth and fifth latching mechanisms.

13. The variable valve lift apparatus of claim 7, wherein the lash adjuster is a hydraulic lash adjuster.

14. The variable valve lift apparatus of claim 7, wherein the lash adjuster is a mechanical lash adjuster.

15. The variable valve lift apparatus of claim 7, wherein the oil pipe is arranged at a lateral side of the lash adjuster.

16. The variable valve lift apparatus of claim 7, wherein the oil pipe is arranged below the lash adjuster.

17. The variable valve lift apparatus of claim 7, wherein an oil delivery passage for delivering oil from the oil pipe to the rocker arm is formed inside the lash adjuster.

18. The variable valve lift apparatus of claim 7, further comprising a motor connected with the oil pipe, wherein:

a plurality of oil supply holes for supplying oil to the plurality of lash adjusters are formed at an exterior circumference of the oil pipe; and the plurality of oil supply holes comprise a plurality of penetration holes formed at the exterior circumference of the oil pipe with different angular positions.

19. The variable valve lift apparatus of claim 18, wherein the plurality of oil supply holes comprise a plurality of penetration holes formed at the exterior circumference of the oil pipe with the same angular position.

* * * * *